US005888064A

United States Patent [19]

Stubbs

[11] Patent Number: 5,888,064

[45] Date of Patent: Mar. 30, 1999

[54] AIR-POWERED DENTAL TOOL FOR ANIMALS AND METHOD OF USE

[76] Inventor: R. Clay Stubbs, HC3 Box 38, Johnson City, Tex. 78636

[21] Appl. No.: 109,524

[22] Filed: Jul. 2, 1998

Related U.S. Application Data

[63] Continuation-in-part of Ser. No. 880,782, Jun. 23, 1997, abandoned.

[51] Int. Cl.[6] ..... A61D 5/00

[52] U.S. Cl. ..... 433/1; 433/118

[58] Field of Search ..... 433/1, 118, 120, 433/125, 126, 133, 105, 112; 606/85, 171, 177; 132/73.6, 75.8

[56] References Cited

U.S. PATENT DOCUMENTS

| | | | |
|---|---|---|---|
| 391,304 | 10/1888 | Eden | 433/118 |
| 741,519 | 10/1903 | Mahaffy | 433/1 |
| 889,462 | 6/1908 | Je | 433/1 |
| 1,821,079 | 9/1931 | Schultze | 132/73.6 |
| 3,640,280 | 2/1972 | Slanker et al. | 433/118 |
| 5,235,363 | 8/1993 | Meller | 433/120 |

OTHER PUBLICATIONS

Mikita Model 4399D and 4399DW, Cordless Equine Rasp, Jan. 1993.

Equi–Dent Technologies, Inc., Rasp for Horses, Feb. 1996.

*Primary Examiner*—John J. Wilson

*Attorney, Agent, or Firm*—Ted Masters

[57] ABSTRACT

A air-powered dental tool (20) for animals such as the equine species includes a dental rasp (34) which reciprocates at at least 3,000 oscillations per minute, and has a stroke of approximately 10 millimeters. In a preferred embodiment, dental tool (20) further includes a noise abatement system which routes the exhaust compressed air to a remote location away from the animal and using veterinarian.

11 Claims, 7 Drawing Sheets

AIR-POWERED DENTAL TOOL FOR ANIMALS AND METHOD OF USE

CROSS REFERENCE TO RELATED APPLICATION

This application is a Continuation-In-Part of U.S. patent application Ser. No. 08/880,782, filed Jun. 23, 1997, now abandoned, the disclosure of which is included herein by reference.

TECHNICAL FIELD

The present invention pertains to dental tools for use on animals such as members of the equine species, and more particularly to rasps for removing over length tooth crowns and sharp edges.

BACKGROUND ART

The teeth of the equine species continuously grow, and as such it is necessary to periodically file off overgrown surfaces and sharp projecting edges. The filing process is also known as rasping or "floating". Absent this periodic treatment, the animal's teeth will grow to a point where it can experience difficulty in chewing, or can develop tooth induced ulcerations of the soft mouth tissue and tongue. Devices to file a horse's teeth are well known in the art. They range from hand-held floats and rasps, to rasps mounted upon both reciprocating and rotary power tools. For example, U.S. Pat. No. 579,966 shows a veterinary file holder. Two lips or flanges are secured to a wire member, forming salient edges which overlap the edges of a file. U.S. Pat. No. 5,533,894 defines an equine dental float which includes a handle with a head at one end. The head has a trough-like structure with a plurality of individual teeth mounted in the trough. A pin mounted through an aperture in each of the plurality of teeth aligns the teeth and removably connects the teeth within the trough. Each tooth is polygon in shape and has a plurality of cutting edges, with one of the cutting edges of each tooth projecting upwardly out of the trough to form a filing surface. German Patent 26 37 915 depicts a tool for filing horse teeth having a reciprocating rasp in a U/rail supported by a rod connected to a drive housing. The joint between the rod and the housing is formed by a plate attached to the end of the rod and covering the housing interior and the drive mechanism. The tool can be handled more safely and allows rapid filing down of teeth without insertion of a lock in the horse's mouth. German Patent 30 02 386 comprises a teeth grinding instrument intended for the molars of horses having a motordriven grindstone. The grindstone is coupled by a chuck to a compressed air motor. The device also has one or more air outlet ports, together with a water pipe spraying onto the grinding area, and one or more fiber optic light sources. French Patent 1.052.653 describes 15 a rotary grinding device for animal dentistry. Mikita Model 4399D and 4399DW discloses a Cordless Equine Rasp. This device operates an 2,700 strokes per minute, has a 5/32 inch stroke, and weighs 5.3 lbs. Rotary motion provided by an electric is mechanically converted to reciprocating motion. The tool is marketed by the Mikita Corp. 3-11-8, Sumiyoshi-cho, Anjo, Aichi 446 Japan. EQUI-DENT Technologies, Inc., P.O. Box 5877, Sparks Nev. 89432-5877 (702) 358-6695, also markets an electrically powered reciprocating rasp for horses which operates at 1,200 oscillations per minute, has a 1 and 3/16 inch stroke, and weighs approximately 7.4 lbs. Mikita Model TR 3000V reciprocating saw forms the basis for the EQUI-DENT rasp.

None of the aforementioned prior art equine dentistry devices utilize compressed air to directly drive a rasp in a reciprocating fashion. Further, the aforementioned electricallydriven devices operate at no load speeds of no more than 2,700 oscillations per minute. When loaded down with the weight of a rasp and shaft, the speed of these devices is reduced substantially.

DISCLOSURE OF INVENTION

The present invention comprises an improved dental tool for animals such as the equine species. The tool employs several novel principles, which singularly, and even more dramatically in combination, result in a substantial advancement in the art of animal dentistry. The tool is used to file down (float) the teeth of horses or other members of the equine family. The principal design feature of the present invention resides in the use of compressed air to directly drive a reciprocating rasp. No prior art device employs this principle. The rasp of the present invention reciprocates at at least 3,000 oscillations per minute when loaded with a rasp and shaft, thereby greatly exceeding even the unloaded performance of the prior art devices. This increased speed results in a correspondingly shortened treatment time, thereby benefiting both the animal and the veterinarian. Moreover, the present invention utilizes a noise abatement system which substantially reduces the noise associated with pneumatically operated devices. Again, both the animal and the veterinarian are benefactors. Principal features and advantages of the present invention are:

FILING SPEED—The present invention utilizes compressed air to operate at over 3,000 oscillations per minute with the rasp and shaft attached. This is substantially higher than the operating speed of the prior art devices. Resultantly, the present invention requires that a minimum of pressure be applied during the filing process.

NOISE ABATEMENT—The present invention reduces the noise associated with the rasping operation, by venting the exhaust compressed air to a remote location away from the animal and using veterinarian. With the present invention, the produced noise is substantially less than that of an electrically driven rasping tool.

WEIGHT—The present invention weighs approximately 2 lbs, as compared to over 5 lbs and 7 lbs for the previously cited prior art devices. The present invention is therefore less tiring to use, and is much easier to handle and maneuver.

RASP STROKE—Some of the prior art devices utilize a rasp stroke of over 1 inch. This is troublesome in that the rasp can easily chip, break, or loosen a tooth if it is not used properly, and is not continuously visually monitored by the using veterinarian. Equally disturbing, a rasp having a long stroke is prone to lacerate the animal's tongue, soft mouth tissue, or even a finger of the veterinarian. To compensate for this deficiency, hand rasping is recommended in many areas of the animal's mouth. Other prior art devices, employ a very short stroke (0.15 inches), resulting in an inordinately lengthy time to accomplish the required filing.

The present invention overcomes these shortfalls of the prior art devices. By using a relatively short stroke distance of approximately 10 millimeters (about 0.4 inches), the possibility of injury to the animal or veterinarian is minimized. In fact, the present invention can be operated by "feel" as opposed to requiring the continuous visual monitoring of the using veterinarian. This is very important in that it is difficult, if not impossible, to view the rear molars of the animal while performing the filing operation. With the present invention however, even the troublesome 3rd molar can be readily treated. Additionally, by operating at at least 3,000 oscillations per minute with a 10 millimeter stroke, the necessary filing can be accomplished in a minimum time. And, all rasping operations can be performed with the present invention. That is, there is no need for supplemental hand rasping, or for the use of other power tools, as is the case with some of the prior art devices.

ELECTRIC SHOCK

As the present invention is air-driven, there is no danger whatsoever due to electric shock.

The present invention also has the advantage that it does not create the carcinogenic dust that can be produced by high speed rotary dental tools.

In accordance with a preferred embodiment of the invention, a dental tool for animals such as the equine species comprises an air-powered reciprocating mechanism, the mechanism being reciprocatingly movable along an axis, a shaft oriented substantially along the axis, the shaft having a first end and a opposite second end, the first end connected to the mechanism, a dental rasp connected to the second end of the shaft, so that when said mechanism is activated by compressed air said dental rasp reciprocates along said axis.

In accordance with another preferred embodiment of the invention, the dental rasp reciprocates at at least 3,000 oscillations per minute.

In accordance with an important aspect of the invention, the reciprocating dental rasp has a stroke distance of approximately 10 millimeters.

In accordance with an important feature of the invention, the shaft is rotationally locked in a chuck. The chuck has two opposite parallel sides, a guide is connected to the body, the guide having an aperture having parallel walls which receive the parallel sides of the chuck, so that the chuck cannot rotate within the guide.

In accordance with another important aspect of the invention, the rasp comprises a two-sided planar member, one side having a plurality of cutting blades, the planar member forming an angle of between substantially 0° and 30° with the shaft.

In accordance with another preferred embodiment of the invention, the mechanism has an exhaust chamber for venting exhaust compressed air. An exhaust port hose fitting penetrates the exhaust chamber so that the exhaust compressed air can escape through the hose fitting. An exhaust hose is connected to the exhaust port hose fitting, so that the exhaust compressed air can flow through the hose and away from the dental tool.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
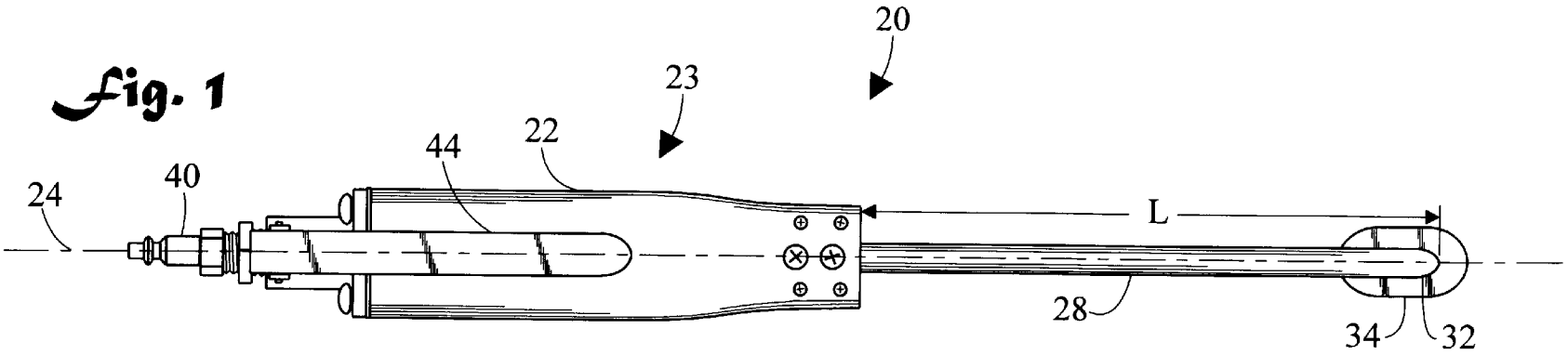
FIG. 1 is a top plan view of an air-powered equine dental tool in accordance with the present invention.
Figure 2:
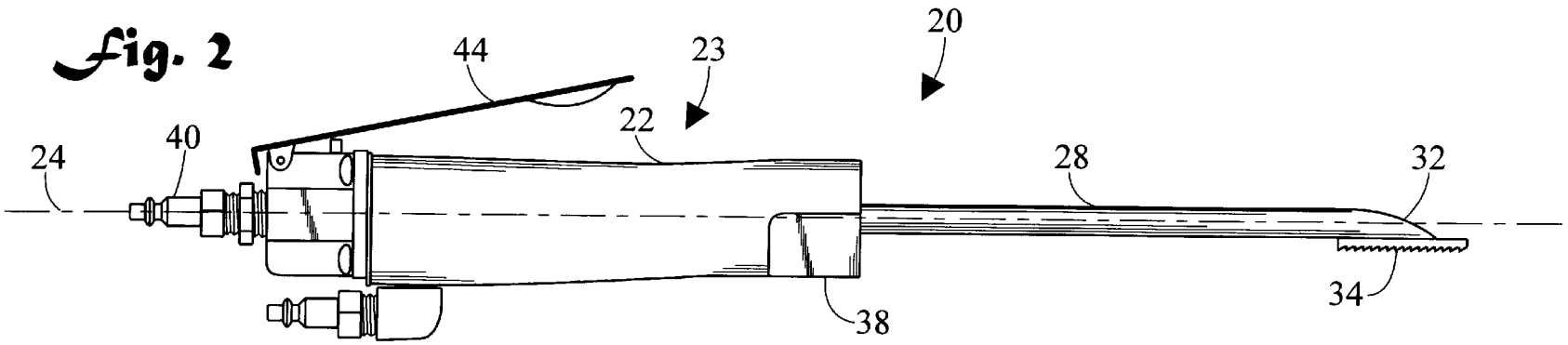
FIG. 2 is a side elevation view of the dental tool.
Figure 3:
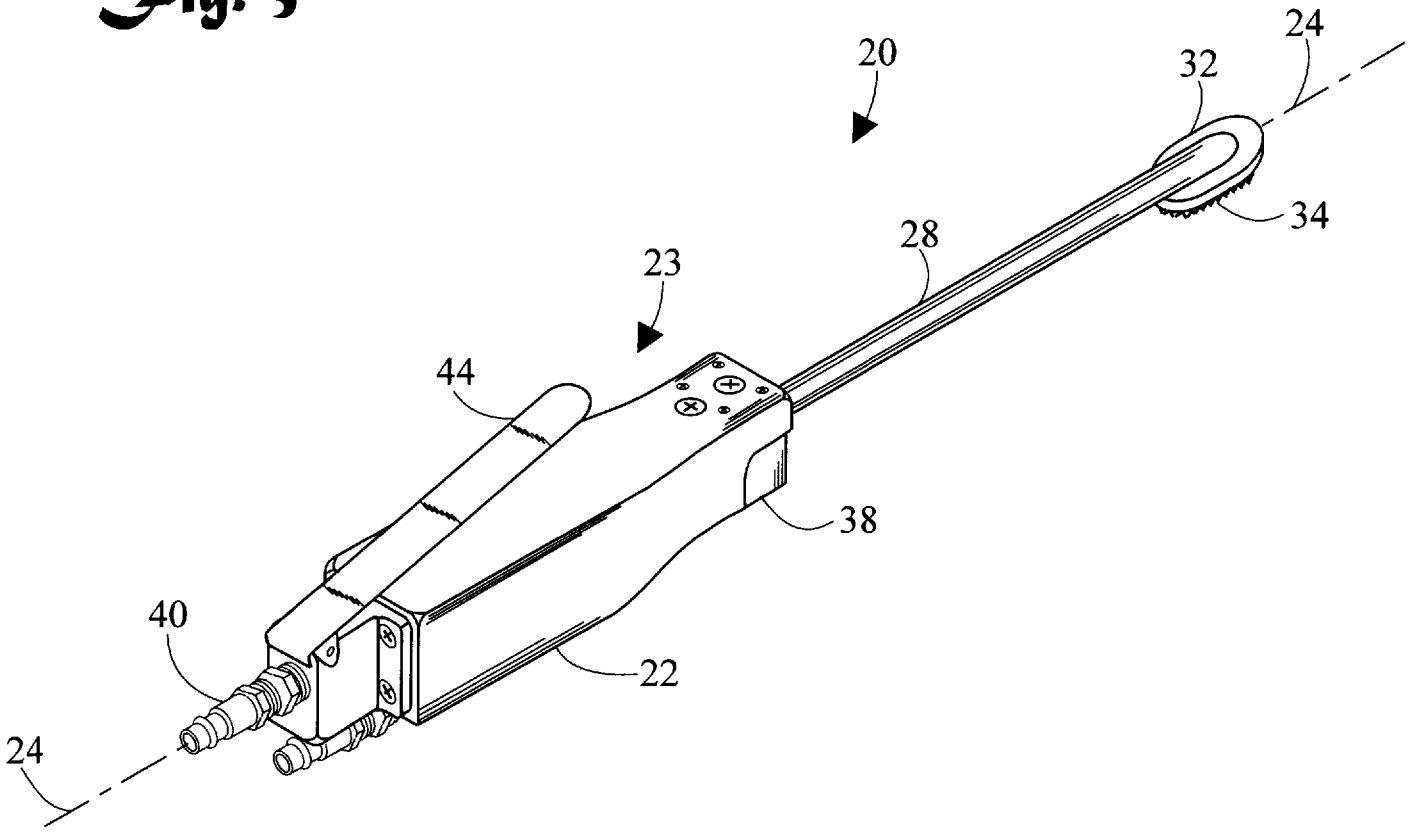
FIG. 3 is a perspective view of the dental tool.

Referring initially to FIGS. 1, 2, and 3, there are illustrated top plan, side elevation, and perspective views respectively of an air-powered dental tool in accordance with the present invention, generally designated as 20. An air-powered reciprocating mechanism 23 having a body 22 is reciprocatingly movable along an axis 24. A shaft 28 having a first end 30 (refer to FIG. 7) and an opposite second end 32 is oriented substantially along axis 24. Shaft 28 may be of different lengths L to accommodate various filing needs. First end 30 of shaft 28 is connected to air-powered reciprocating mechanism 23. A dental rasp 34 is connected to second end 32 of shaft 28. A air-powered reciprocating mechanism 23 has a reciprocating piston 36 (refer to FIG. 7). Piston 36 is connected to a chuck 26, which in turn is removably connected to first end 30 of shaft 28. When the air-powered reciprocating mechanism 23 is activated by compressed air, piston 36 reciprocates, causing chuck 26, shaft 28, and dental rasp 34 to reciprocate along axis 24 at at least 3,000 oscillations per minute.

Air-powered reciprocating mechanism 23 of dental tool 20 is commercially available under the trade name "Air Body Saw", item number 00113-1ASA, from Harbor Freight Tools, 3491 Mission Oaks Blvd, P.O. Box 6010, Camarillo, Calif. 93011-6010, (800)423-2567. This device is marketed as a saber saw. In the present invention, the saber saw blade, work guide, and biede chuck are removed and replaced with chuck 26, shaft 28, dental rasp 34, hardened guide 38, and connecting hardware (refer to FIG. 6). The Air Body Saw operates at a no load speed of about 9,000 oscillations per minute, has a approximate 10 mm (0.4 inch) stroke, consumes 6 cubic feet per minute (CFM) of 90 PSI compressed air, and has a ¼ inch NPT air inlet 40. It is of importance, that while the reciprocating mechanism 23 of the Air Body Saw is designed to operate from a 90 PSI, 6 CFM compressed air source, it can also operate satisfactorily at 60 PSI and 3.9 CFM with some reduction in performance. This is highly advantageous in emergency situations where only a small portable air compressor is available. Other sources of the Air Body Saw are (1) Northern, P.O. Box 1499 Burnsville, Minn. 55337-0499, item number 15764-C117, (800) 533-5545, and (2) Enco Manufacturing Co., Bloomingdale, Chicago, Ill. 60639, Model Number 801-1302, (800) 873-3626.

Figure 4:
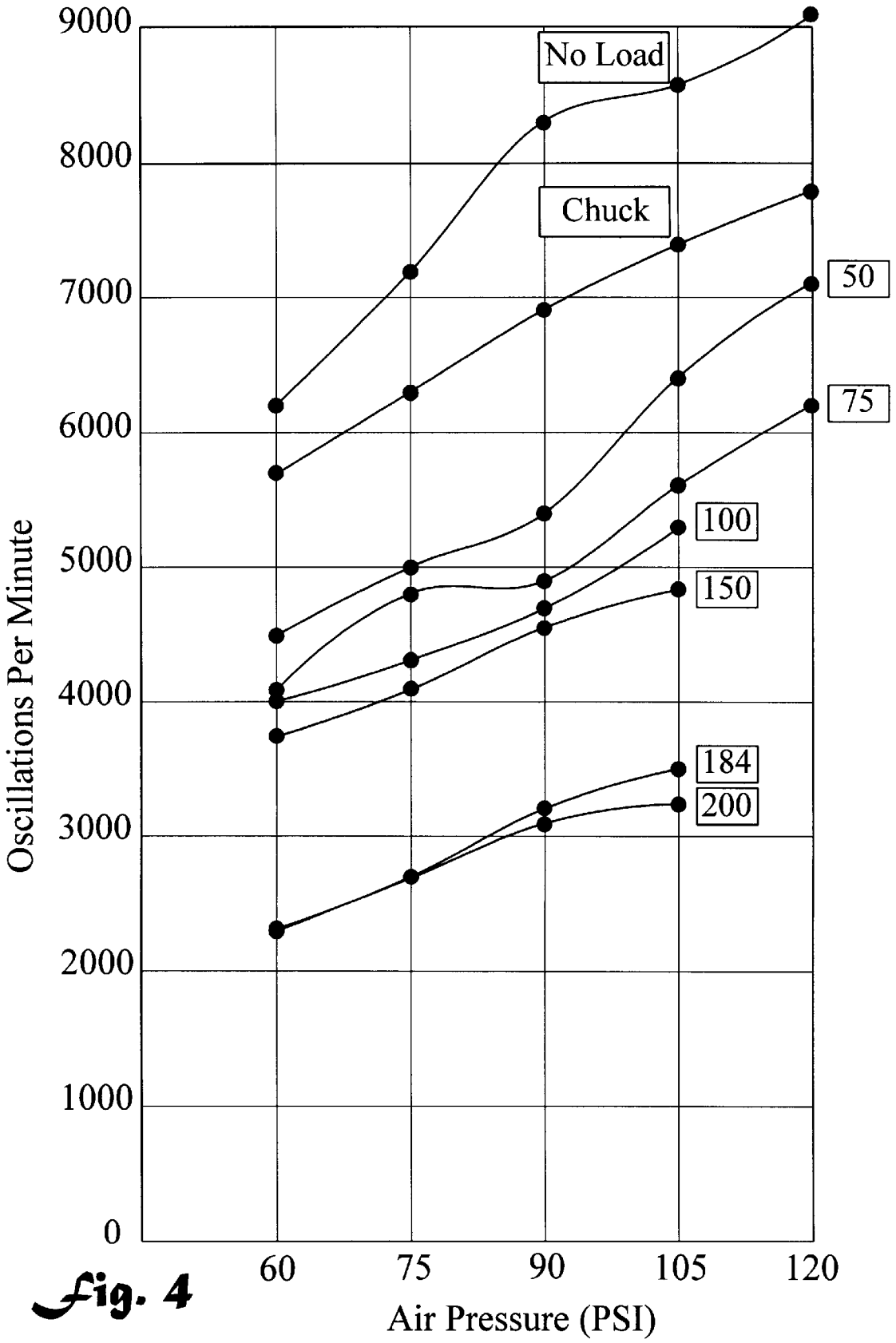
FIG. 4 is a plot of dental tool performance.

FIG. 4 is a plot of dental tool 20 performance showing dental rasp 34 oscillations per minute (OPM) as a function of air pressure (PSI) and load (in grams). This data was obtained through empirical measurement and is also shown in Table 1 below. It is initially observed that air-powered reciprocating mechanism 23 reciprocates at 8,300 OPM under no load conditions. This is slightly less than the 9,000 OPM claimed by the manufacturer. It is also noted that reciprocating devices such as the present invention and the cited prior art are all rated under no load conditions. As can be seen from the FIG. 4 data, OPM performance drops significantly as a load is attached. When chuck 26 is added, OPM decreases to 6,900 OPM at a nominal 90 PSI. When a 200 gram combined rasp 34 and shaft 28 weight is added, OPM drops to 3,200.

TABLE 1

| Load | PSI 60 | 75 | 90 | 105 | 120 |
|---|---|---|---|---|---|
| No Load | 6200 | 7200 | 8300 | 8600 | 9100 |
| w/Chuck | 5700 | 6300 | 6900 | 7400 | 7800 |
| 50 grams | 4500 | 5000 | 5400 | 6400 | 7100 |
| 75 grams | 4100 | 4800 | 4900 | 5700 | 6200 |
| 100 grams | 4000 | 4300 | 4700 | 5300 | |
| 150 grams | 3750 | 4100 | 4550 | 4850 | |
| 184 grams | 2320 | 2700 | 3200 | 3500 | |
| 200 grams | 2300 | 2700 | 3100 | 3240 | |

In a preferred embodiment of the present invention, shaft 28 and rasp 34 have a combined weight of between 150 and 184 grams, and dental tool 20 is driven by compressed air at 90 PSI. From FIG. 4, under these conditions dental tool operates between approximately 3,200 and 4,550 OPM. Empirical testing has shown that a speed of at least 3,000 OPM gives the best dentistry results.

It may also be noted that for a 150 gram load, a very useful 3,700 OPM can be achieved at a low working PSI of 60 lbs. This is useful in instances where only a small compressor is available.

Figure 5:
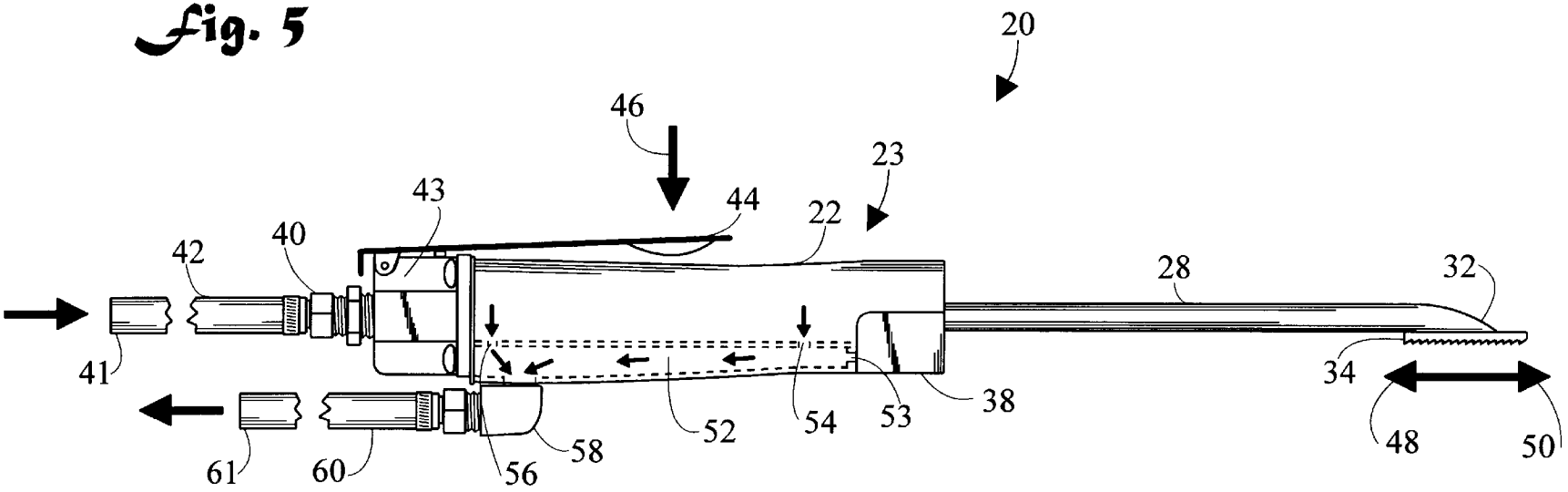
FIG. 5 is a side elevation view showing a noise abatement system.
Figure 6A:
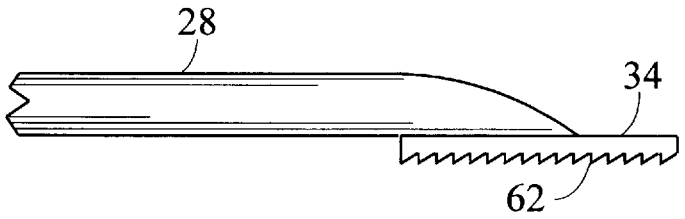
FIG. 6 is an enlarged side elevation view showing various rasp configurations.
Figure 6B:
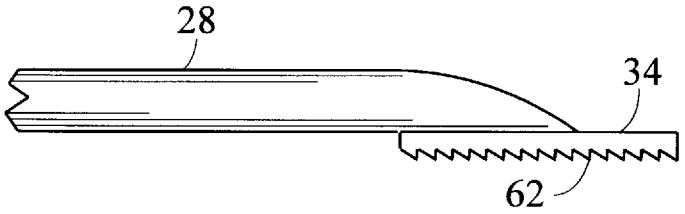
Figure 6C:
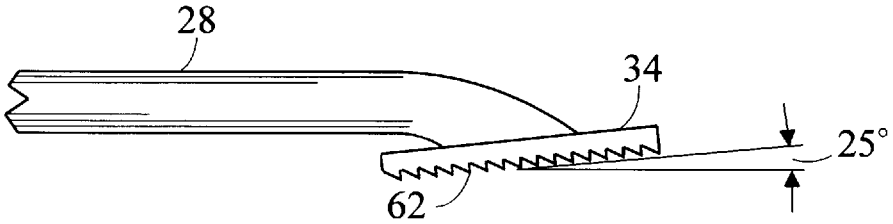
Figure 6D:
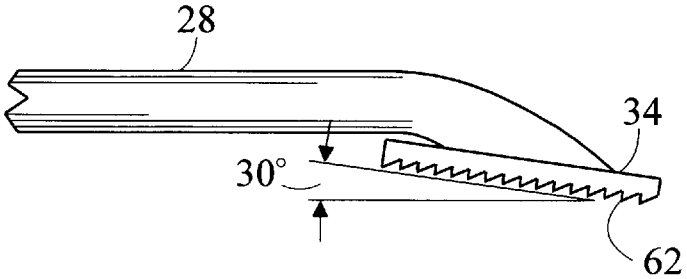

FIG. 5 is a side elevation view showing the noise abatement system of the present invention. Compressed air enters dental tool 20 through hose 42 and air inlet port 40. Air-powered reciprocating mechanism 23 has a throttle lever 44, so that when throttle lever 44 is pressed in direction 46, mechanism 23 is activated which causes rasp 34 to oscillate in directions 48 and 50. Mechanism 23 has an exhaust chamber 52 for venting exhaust compressed air. Exhaust chamber 52 includes front 54 and rear 56 exhaust entrances through which exhaust air is delivered by the air-powered reciprocating mechanism 23. In the unmodified Air Body Saw, exhaust air is release from exhaust chamber 52 through an existing exhaust port 53. In the present invention, existing exhaust port 53 is plugged, and an exhaust port hose fitting 58 is installed in a taped hole in body 22, the exhaust port fitting 58 penetrates the exhaust chamber 52 so that the exhaust compressed air can now escape through exhaust port hose fitting 58. It is noted that in the present invention, the valve block 43 has been rotated 180° so that the throttle lever 44 does not interfere with the exhaust port hose fitting 58. An exhaust hose 60 is connected to exhaust port hose fitting 58, so that the exhaust compressed air flows through exhaust hose 60 and is carried away from the dental tool 20, the animal patient, and the using veterinarian. It may be appreciated that absent the noise abatement system of the present invention, the exhaust compressed air is vented at the dental tool 20 thereby causing a high noise level. However, by adding the exhaust port hose fitting 58 and exhaust hose 60, the noise of the escaping air is routed away from the animal and the veterinarian thereby eliminating an otherwise objectionable feature of compressed air tools. In a preferred embodiment, the air compressor and the terminal ends 41 and 61 of the supply hose 42 and exhaust hose 60 respectively, are located 15 and 50 feet from the dental tool. Additionally in the present invention, since the size of the opening in the exhaust port hose fitting is greater than that of the unmodified Air Body Saw, back pressure on the air-powered reciprocating mechanism is reduced.

FIG. 6 is an enlarged side elevation view showing various dental rasp 34 configurations. Dental rasp 34 consists of a two-sided planar member, one side having a plurality of cutting blades 62. In FIG. 6*a* blades 62 are oriented to cut on the reverse stroke, and in FIG. 6*b* blades 62 are reversed so that they cut on the forward stroke. The desired direction of cutting is a function of which teeth are being treated. For example, it is usually best to rasp the back teeth on the reverse stroke. In FIGS. 6*a* and 6*b* the plane of dental rasp is substantially aligned with shaft 28 (0° tilt). In FIG. 6*c*, dental rasp 34 has been tilted to form an angle of about and 25° with shaft 28. By tilting the plane of dental rasp 34 slightly, cutting will only take place in one direction, on the forward stroke in FIG. 6*c*. Similarly in FIG. 6*d*, dental rasp 34 is reversed to only cut on the reverse stroke. In FIG. 6*d* the plane of dental rasp 34 has been tilted to form an angle of about 30° with shaft 28. Referring again to FIG. 1, it may be noted that the planar member of dental rasp 20 has rounded edges when viewed perpendicular to the plane of the dental rasp 34. This is to minimize possible injury to the animal or using veterinarian.

Figure 7:
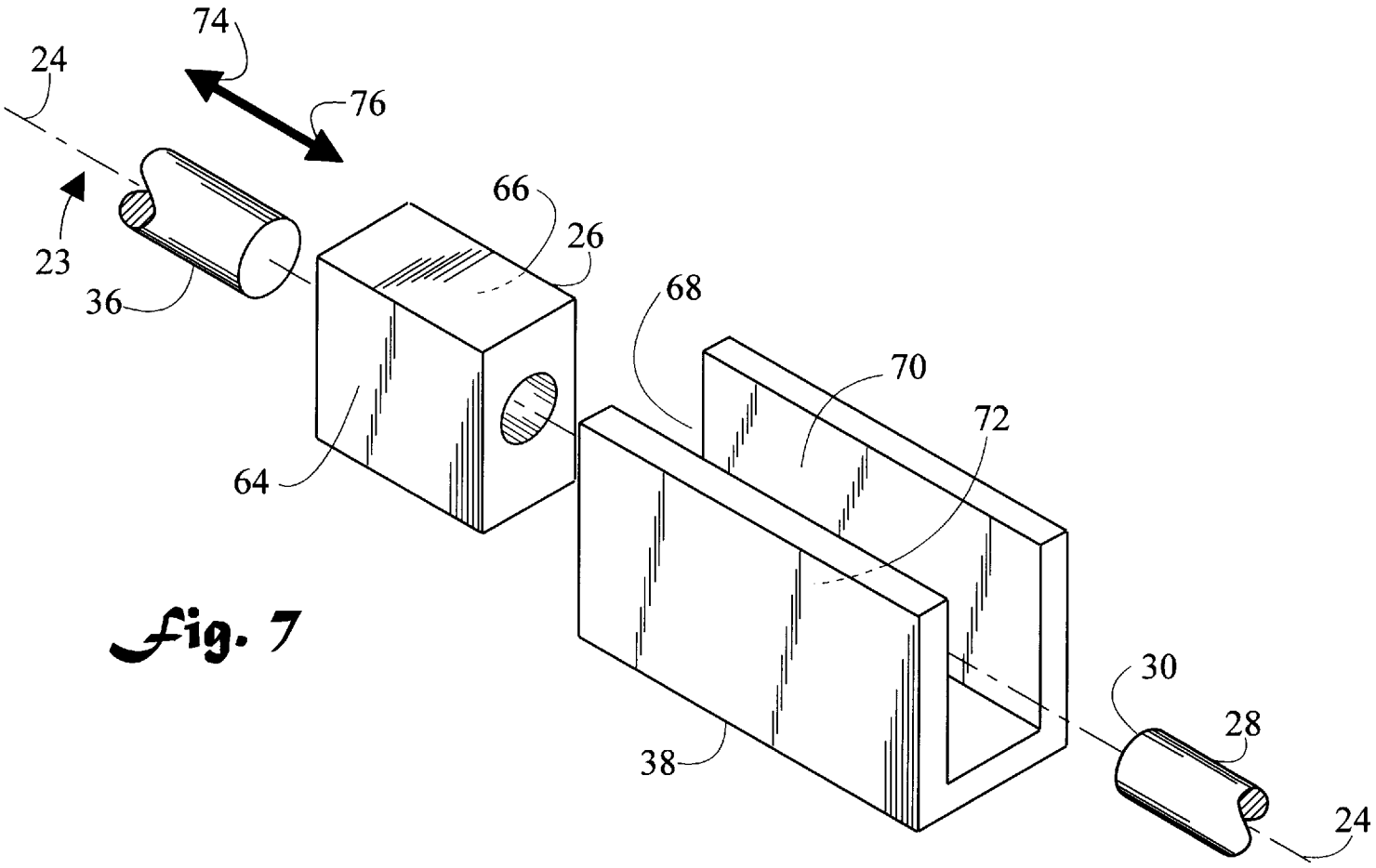
FIG. 7 is an enlarged exploded view of a chuck and hardened guide.
Figure 8:
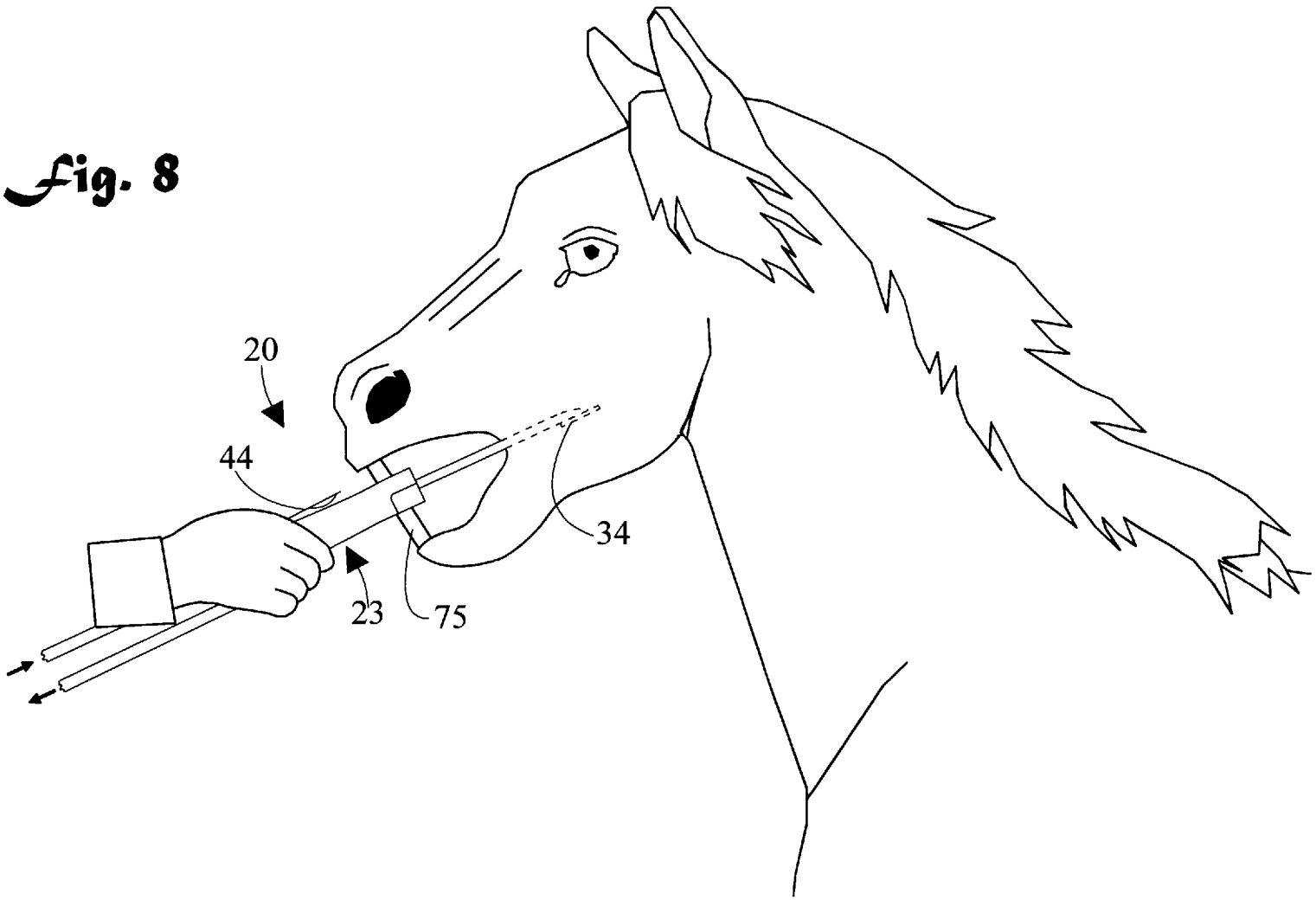
FIG. 8 is a reduced side elevation view of the dental tool in use.

FIG. 7 is an enlarged exploded view of a chuck 26 and a hardened guide 38. Shaft 28 is rotationally locked in chuck 26. Chuck 26 is connected to piston 36 and has two opposite parallel sides 64 and 66. Hardened guide 38 is fixedly connected to body 22 of mechanism 23, and has an aperture 68 having parallel side walls 70 and 72 which receive parallel sides 64 and 66 of chuck 26, so that chuck 26 cannot rotate within guide 38 as chuck 26 oscillates back and forth in directions 74 and 76. In a preferred embodiment, hardened guide 38 is fabricated from stainless steel, heat treated, type 420. FIG. 8 is a reduced side elevation view of dental tool 20 in use. The present invention allows the using veterinarian to file the animal's teeth by "feel", and does not require constant visual contact with the dental rasp 34. This is particularly significant when filing is required on the animal's rear teeth or molars, since constant visual contact with the dental rasp 34 is not possible in these confined recesses of the mouth. The first step in the filing process is to install a full-mouth speculum 75 to hold the animal's mouth open. The using veterinarian then grasps mechanism 23 in the right hand (for a right handed veterinarian) and places the dental rasp 34 in the animal's mouth adjacent to the rear teeth or molars. The veterinarian then places the left hand in the animal's mouth so that his/her fingers can feel both the dental rasp 34 and the area of the rear teeth to be filed. The veterinarian can then without looking use his/her left hand to position dental rasp 34 on the area of the rear teeth to be filed. The right thumb or fingers (depending upon how dental tool 20 is held) then presses the throttle lever 44 and causes dental rasp 34 to reciprocate at at least 3,000 oscillations per minute, and uses dental rasp 34 to file the desired area of the animal's teeth. After, a period of filing, the veterinarian releases the throttle lever 44, and inspects by feel the filed area with the fingers of the left hand. The veterinarian then continues the process by sequentially placing the dental rasp, pressing the throttle lever 44, filing the teeth, releasing the throttle lever 44, and inspecting the work area until the teeth are properly filed.

It is noted that while the present invention is designed specifically for filing the teeth of members of the equine species, it can of course be utilized on other animals as well.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A dental tool for animals such as the equine species, comprising: an air-powered reciprocating mechanism, said mechanism reciprocatingly movie along an axis;

a shaft oriented substantially along said axis, said shaft having a first end and a opposite second end, said first end connected to said mechanism;

a dental rasp connected to said second end of said shaft; and, so that when said mechanism is activated by compressed air said dental rasp reciprocates along said axis at at least 3,000 oscillations per minute.

2. A dental tool according to claim 1, further including:

a chuck connected to said mechaism; and, said first end of said shaft connected to said chuck.

3. A dental tool according to claim 2, further including:

said shaft rotationally locked in said chuck;

said chuck having two opposite parallel sides; and, a guide connected to said mechanism, said guide having an aperture having parallel walls which receive said parallel sides of said chuck, so that said chuck cannot rotate within said guide.

4. A dental tool according to claim 3, wherein said chuck and said guide are fabricated from stainless steel, heat treated, type 420.

5. A dental tool for animals such as the equine species, comprising:

an air-powered reciprocating mechanism, said mechanism reciprocatingly movable along an axis;

a shaft oriented substantially along said axis, said shaft having a first end and a opposite second end, said first end connected to said mechanism;

a dental rasp connected to said second end of said shaft;

so that when said mechanism is activated by compressed air said dental rasp reciprocates along said axis; and, said dental rasp having a stroke distance of approximately 10 millimeters.

6. A dental tool for animals such as the equine species, comprising:

an air-powered reciprocating mechanism, said mechanism reciprocatingly movable along an axis;

a shaft oriented substantially along said axis, said shaft having a first end and a opposite second end, said first end connected to said mechanism;

a dental rasp connected to said second end of said shaft;

so that when said mechanism is activated by compressed air said dental rasp reciprocates along said axis;

said rasp comprising a two-sided planar member, one side having a plurality of cutting blades disposed thereon; and, said planar member forming an angle of between substantially 0° and 30° with said shaft.

7. A dental tool according to claim 6, further including said planar member having rounded edges when viewed perpendicular to said plane.

8. A dental tool for animals such as the equine species, comprising:

an air-powered reciprocating mechanism, said mechanism reciprocatingly movable along an axis;

a shaft oriented substantially along said axis, said shaft having a first end and a opposite second end, said first end connected to said mechanism;

a dental rasp connected to said second end of said shaft;

so that when said mechanism is activated by compressed air said dental rasp reciprocates along said axis;

wherein said dental rasp reciprocates at at least 3,000 oscillations per minute;

said dental rasp having a stroke distance of approximately 10 millimeters;

said mechanism having an exhaust chamber for venting exhaust compressed air; and, an exhaust hose connected to said exhaust chamber so that the exhaust compressed air can flow through said exhaust hose and away from said dental tool.

9. A method for filing the rear teeth of animals such as the equine species, comprising the steps of:

providing a dental tool including, an air-powered mechanism reciprocatingly movable along an axis, a shaft oriented substantially along said axis, said shaft having a first end and a opposite second end, said first end connected to said mechanism, a dental rasp connected to said second end of said shaft, said mechanism having a throttle lever, so that when said throttle lever is pressed, said mechanism is activated by compressed air;

providing a full-mouth speculum;

installing the full-mouth speculum in the animal's mouth;

grasping said mechanism with a first hand;

placing said rasp in the mouth of the animal adjacent to the rear teeth;

placing a second hand in the mouth of the animal so the fingers of the second hand can feel both said rasp and the area of the rear teeth to be filed;

without looking, using the second hand to position said rasp on the area of the rear teeth to be filed;

pressing said throttle lever to cause said rasp to reciprocate;

using said rasp to file the desired area of the animal's teeth;

inspecting by feel the filed area with the fingers of the second hand; and, sequentially placing said rasp, pressing said throttle lever, filing, and inspecting until the teeth are properly filed.

10. The method according to claim 9, further including the step of:

said rasp reciprocating at at least 3,000 oscillations per minute.

11. A method for filing the teeth of animals such as the equine species, comprising the steps of:

providing a dental tool including an air-powered mechanism reciprocatingly movable along an axis, a shaft oriented substantially along said axis, said shaft having a first end and a opposite second end, said first end connected to said mechanism, a dental rasp connected to said second end of said shaft, said mechanism having a throttle lever, so that when said throttle lever is pressed, said mechanism is activated by compressed air;

further providing said mechanism having an exhaust chamber for venting exhaust compressed air, and an exhaust hose connected to said exhaust chamber so that the exhaust compressed air can flow through said exhaust hose and away from said dental tool;

providing a full-mouth speculum;

installing the full-mouth speculum in the animal's mouth;

grasping said mechanism with a first hand;

placing said rasp in the mouth of the animal adjacent to teeth to be filed;

pressing said throttle lever to cause said rasp to reciprocate at at least 3,000 oscillations per minute; and, using said rasp to file the animal's teeth.

* * * * *

UNITED STATES PATENT AND TRADEMARK OFFICE

CERTIFICATE OF CORRECTION

PATENT NO. : 5,888,064
DATED : March 30, 1999
INVENTOR(S) : R. Clay Stubbs

It is certified that error appears in the above-identified patent and that said Letters Patent is hereby corrected as shown below:

In claim 1, column 6, line 62, delete "movie" and insert - - movable - - therefor.

Signed and Sealed this

Twenty-eighth Day of September, 1999

*Attest:*

Q. TODD DICKINSON

*Attesting Officer*

*Acting Commissioner of Patents and Trademarks*